US005271823A

United States Patent [19]

Schachameyer et al.

[11] Patent Number: 5,271,823

[45] Date of Patent: Dec. 21, 1993

[54] METHOD OF MAKING A TRIVALENT CHROMIUM PLATED ENGINE VALVE

[75] Inventors: Steven R. Schachameyer, Whitefish Bay, Wis.; Paul A. Bujalski, Battle Creek; Sundaram L. Narasimhan, Marshall, both of Mich.

[73] Assignee: Eaton Corporation, Cleveland, Ohio

[21] Appl. No.: 899,966

[22] Filed: Jun. 17, 1992

[51] Int. Cl.[5] ..... C25D 3/06

[52] U.S. Cl. ..... 205/224; 205/319; 205/229

[58] Field of Search ..... 205/287, 288, 289, 224, 205/50, 229, 319

[56] References Cited

U.S. PATENT DOCUMENTS

| | | | |
|---|---|---|---|
| Re. 29,749 | 8/1978 | Gyllenspetz et al. | 204/43 T |
| Re. 31,508 | 1/1984 | Barclay et al. | 204/43 R |
| 3,930,527 | 1/1976 | French | 152/330 RF |
| 4,108,770 | 8/1978 | Roy | 210/50 |
| 4,690,735 | 9/1987 | Laitinen et al. | 205/287 |
| 4,804,446 | 2/1989 | Lashmore et al. | 204/104 |
| 4,875,983 | 10/1989 | Alota et al. | 204/28 |

OTHER PUBLICATIONS

Metals Handbook, Desk Edition, American Society for Metals, "Hard Chromium Plating", Donald F. Gagas, pp. 29.14–29.16 (1985).

*Primary Examiner*—Kathryn Gorgos
*Attorney, Agent, or Firm*—A. E. Chrow

[57] ABSTRACT

An internal combustion engine valve (100) is provided having a stem (4) onto which a plating or coating of trivalent chromium is electrodeposited and which is then heated at a temperature of at least about 150° F. for at least about 3 hours to provide a wear resistant surface that is superior to coatings of hexavalent chromium heretofor used for such purpose.

8 Claims, 2 Drawing Sheets

METHOD OF MAKING A TRIVALENT CHROMIUM PLATED ENGINE VALVE

INTRODUCTION

This invention relates generally to an internal combustion engine valve having a wear resistant plating or coating of chromium thereon and more particularly to an engine valve whose stem has been provided with a wear resistant chromium coating that has been electrodeposited from an aqueous solution containing trivalent chromium and then heated at a temperature of at least about 150° F. for at least about thirty minutes to create a complex chromium carbide compound with an admixture of chromium oxides to establish a highly effective bond therebetween as well as to substantially lengthen the time to seizure under simulated operating conditions over that for hexavalent chromium plating heretofor used for such purpose.

BACKGROUND OF THE INVENTION

The stems of internal combustion engine valves are required to reciprocate at high speed and at high temperatures within valve guides while the engine is operating as well as being subjected to bending forces arising from improper seating and/or rocker arm side loads and other conditions of misalignment that in general render the stems susceptible to frictional wear which is even further aggravated under the current trend to increased engine speeds and operating temperatures and decreased availability of lubrication at the valve s stem.

Although the valve stems are generally protected by various methods, chromium plating has been most commonly used to achieve wear durability and improve performance of valve stem motion within the valve guide which acts as a linear bearing and therefore is itself subject to wear by reason of its ultimate contact with the valve stem.

Seizure or sticking of the valve stem in the valve guide is perhaps an even more common mode of stem-guide interference failure than an increase in clearance between the stem and the guide arising from wear for it characteristically results in the valve being seized in the open position which may be followed by combustion chamber leakage and possibly valve breakage in the event the engine piston hits the valve head while the stem is seized in the open position.

Chromium is generally an abundant element in the earth's crust and occurs in oxidated states ranging from $Cr^{+2}$ (divalent) to $Cr^{6+}$ (hexavalent). Heretofore, it was thought that only hexavalent chromium could provide an effective wear resistant surface for internal combustion engine valves for it bonded well to the metallic stem substrate and, even though hexavalent and trivalent chromium exhibit similar as deposited characteristics as a coating, trivalent chromium up until the present invention has not exhibited sufficient hardness or adherance of the coating to the valve stem to withstand the rigors of high speed and high temperature engine operation.

Examples of electrodepositing chromium coatings from a bath containing hexavalent chromium ions are disclosed in U.S. Pat. Nos. 3,930,527 and 4,108,770, the disclosures of which are incorporated herein by reference.

Even technical literature is replete with information concerning electroplating with hexavalent chromium ions and yet is silent on the subject of electroplating with trivalent chromium ions such as in the Article entitled "Hard Chromium Plating" on pages 29.14 through 29.16 in METALS HANDBOOK, Desk Edition published by the American Society for Metals (1985).

An example of an electroplating bath for plating a substrate with trivalent chromium for what appears to be for purposes of corrosion protection is disclosed in U.S. Reissue Pat. No. 29,749, the disclosure of which is incorporated herein by reference. Another example of electrodepositing a coating of trivalent chromium on a substrate for purposes of corrosion protection is disclosed in U.S. Reissue Pat. No. 31,508, the disclosure of which is incorporated herein by reference.

An example of simultaneously electrodepositing a coating of trivalent chromium and chromium oxide for corrosion protection is disclosed in U.S. Pat. No. 4,875,983, the disclosure of which is incorporated herein by reference.

An example of a process for depositing a hard smooth coating of trivalent chromium for both corrosion and wear resistance purposes by including a non-sulfur containing wetting agent in the electrodepositing bath is disclosed in U.S. Pat. No. 4,804,446, the disclosure of which is incorporated herein by reference. The patent however does not disclose whether such coating would provide a suitable wear resistant coating on an internal combustion engine valve and does not disclose or suggest the method of the present invention by which: (i) adhesion and hardness of an electrodeposited trivalent chromium coating is enhanced to the point where it provides an effective wear resistant coating and (2) chromium carbide compound formation may occur leading to the formation of complex chromium carbides in a chromium-chromium oxide matrix as a result of heat treatment after electrodeposition to provide a trivalent chromium coating on an internal combustion engine valve stem that surprisingly is even superior in resisting seizure than hexavalent chromium heretofor used for such purposes.

Thus, in a general sense, the present invention involves converting the engine valve industry from the historical practice of electroplating valve stems with hexavalent chromium ions to electroplating the stems with trivalent chromium ions that heretofor were unable to adhere to the stem sufficiently to withstand the rigors of engine operation and have now been found to be even superior to hexavalent chromium in resisting seizure due to exceptional hardness developed by post-plating heat treatment.

An even greater impetus to convert to electroplating valve stems with trivalent chromium ions rather than hexavalent chromium ions relates to the high toxicity characteristics of hexavalent chromium. The future of the hexavalent type of chromium plating used currently on valve stems is under significant scrutiny in view of the environmental regulations imposed by the Environmental Protection Agency. According to the American Conference of Government and Industrial Hygienists (who study the toxicity of materials for NIOSH and OSHA) hexavalent chromium and its compounds are known as carcinogens and, as yet, no evidence has been observed for the carcinogenic effects of trivalent chromium on laboratory animals unlike hexavalent chromium according to ACGIH publication, Sixth Edition (1991) entitled "DOCUMENTATION OF THRESH-

OLD LIMIT VALUES AND BIOLOGICAL EXPOSURE INDICES".

It has been surprisingly discovered that heat aging after electroplating metallic engine valve stems with trivalent chromium (1) improves the hardness of the plating and the bond between the plating and the stem and; (2) creates chromium carbides upon heat treatment from the co-deposition of both chromium metal and carbon atoms from the trivalent process chemistry used herein to enable the plating to serve as an effective wear surface on the stem under the rigors of engine operation and which, although not completely understood, may contribute to its surprising superiority over hexavalent chromium in resisting seizure as determined under simulated operating conditions.

SUMMARY OF THE INVENTION

Accordingly, it is an object of this invention to provide an internal combustion engine valve whose stem has a trivalent chromium coating thereon that is highly resistant to wear.

It is another object of this invention to provide an internal combustion engine valve whose stem has a trivalent chromium coating electroplated thereupon that has been heat aged to render the chromium an effective wear surface possessing superior resistance to seizure under the rigors of high speed and high temperature engine operation.

It is still another object of this invention to provide a process for coating an internal combustion engine valve stem by electrodeposition of trivalent chromium that is then heat aged to provide an effective wear surface that is highly resistant to seizure under the rigors of high speed and high temperature engine operation.

DESCRIPTION OF SOME PREFERRED EMBODIMENTS

Figure 1:
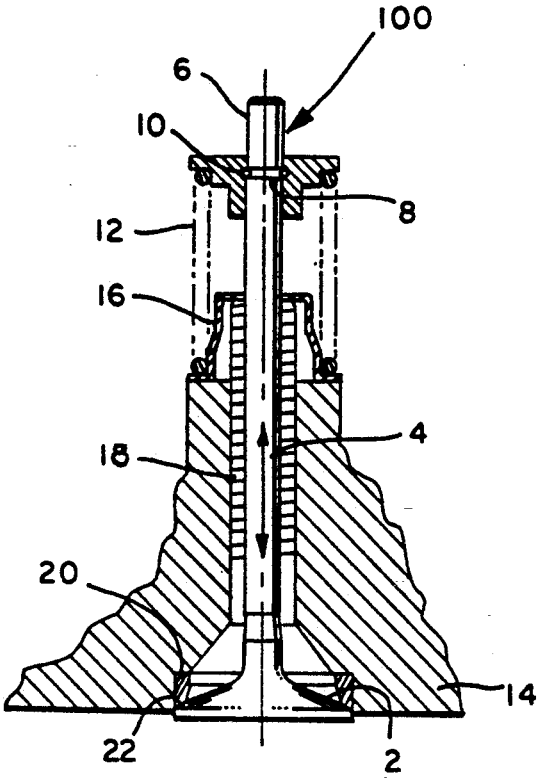
FIG. 1 is a partial central cross-sectional view through a valve 100 extending through an engine block 14.

FIG. 1 illustrates a typical arrangement for mounting a valve 100 such as a poppet valve for reciprocal movement of its stem 4 within a valve guide 18 in an engine block 14. Valve 100 is a metallic valve made from one or more metals selected according to whether valve 100 is an intake or an exhaust valve as is well known to those skilled in engine valve art. Generally, the most common intake valve stem material is a low alloy of hardened and tempered martensitic steel such as SAE 1547 or 8645. A high chromium martensitic steel sold under the trademark Silchrome 1 is known to be widely used for engine valve stems in Europe. The most common exhaust valve material is an austenitic stainless steel strengthened by carbides and nitrides. Nickel base super alloys have also been used in some applications such as in heavy duty diesel engines. In some exhaust valves, it has been the practice to employ two different metals such as where the head referenced by numeral 2 in FIG. 1 is made from austenitic or a nickel based alloy and the stem 4 is made from a low alloy steel.

Head 2 of valve 100 of FIG. 1 has an annular valve seat 22 thereabout that engages a valve seat insert 20 that is secured within an opening extending through engine block 14 to the engine combustion chamber. Valve seat 22 and insert 20 are made from hardened and high temperature and wear resistant materials well known to those skilled in the art. Stem 4 of valve 100 extends through a valve stem guide 18 secured in the opening through engine block 14 and is operative to move reciprocally relative thereto. Typical diametral clearance between an engine valve stem and the stem guide is from about 0.0008 inch to about 0.0030 inch.

The most common guide valve stem material is annealed pearlitic cast iron. In the modern engines with aluminum alloy heads, the cast iron guides are inserted in the cylinder heads and reamed in place concentric with the valve seat prior to assembly, in order to ensure valve alignment. Powdered metal (P/M) steel guides are currently finding increasing applications throughout the world. P/M guides are made by pressing and sintering iron powder with suitable alloy elements. In the cast iron guides, the graphite present in the microstructure of the cast iron provides added wear protection in the form of a solid lubricant. While the P/M guide acts much like an oil impregnated bearing for wear prevention, solid lubricant additions, such as talc, have been known to provide significant additional wear protection.

Stem 4 includes an annular keeper groove 8 at its opposite end adjacent its tip end 6. A retainer 10 is secured in groove 8 and holds a valve spring 12 under compression between retainer 10 and engine block 14. A valve stem seal 16 is preferably secured to the side of the engine block facing away from the combustion chamber to prevent lubricants from entering the combustion chamber. The presence of an engine oil film at the valve guide/stem interface by the leakage of engine oil from the top of the guide, provides protection from adhesive wear. With the mandatory hydrocarbon emission control requirements and the consequent need to restrict the oil leakage into the combustion chamber, tighter oil seals are being used to cap the valve guides in the current engines. The trend has resulted in an increase in the incidents of valve stem guide seizure in many engine systems. The trend toward tighter valve stem seals is expected to continue in the future, demanding better valve stem wear protection systems.

Spring 12 is commonly a coiled spring that operates to urge seat 22 of valve head 2 against insert 20 (upwardly in FIG. 1) to provide a closed condition after it has been moved to its open condition by means of a rotary cam or rocker arm driven by the engine that presses tip 6 of valve 100 downwardly to the open position which is not shown in FIG. 1.

Figure 2:
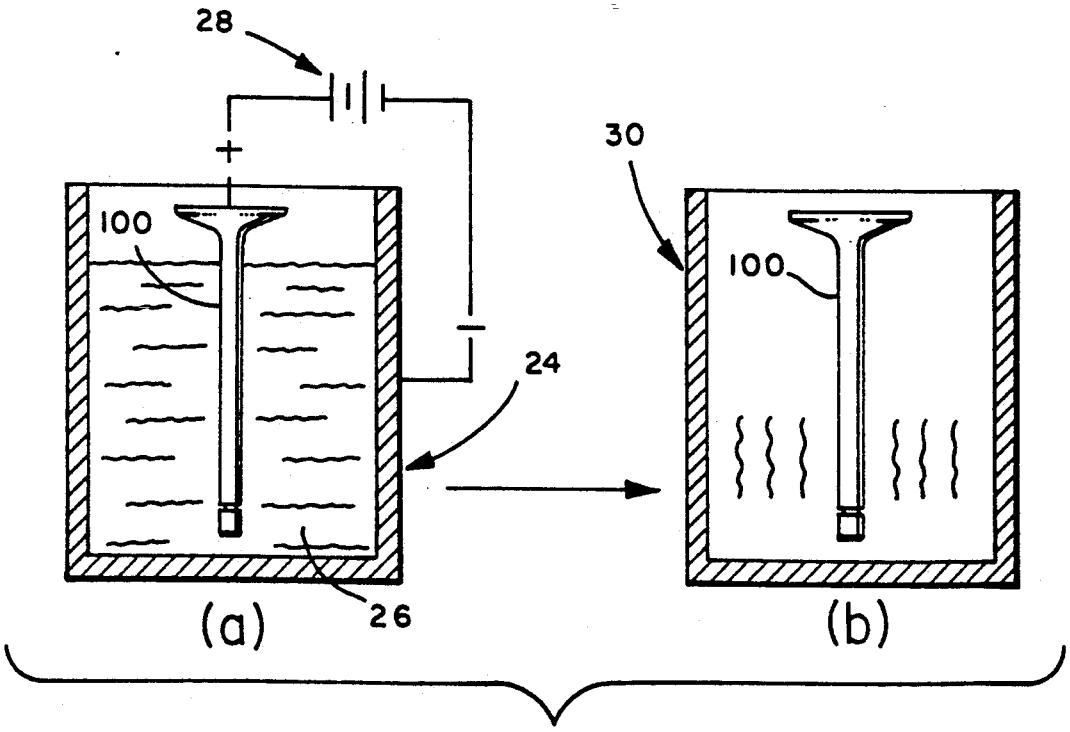
FIG. 2 is a block diagram of the method by which the stem of valve 100 of FIG. 1 is provided with a wear resistant coating from trivalent chromium ions.

FIG. 2 illustrates an embodiment of the method of the invention by which the stem of valve 100 is electroplated with trivalent chromium and then heat treated or aged to provide a chromium coating on the stem that is well adhered and surprisingly exhibits a resistance to seizure that is markedly superior to that exhibited by hexavalent chromium.

In step (a) of FIG. 2, the stem of valve 100 is immersed in an aqueous electroplating solution 26 contained in a bath 24. Although there are various electrolyte solutions for electroplating onto metal and other substrates from a solution containing trivalent chromium ions, the following electrolyte solution, temperature, and electrical current conditions, have been found to provide an effective uniform plating on metallic engine valve stems.

The electrolyte solution used in the method of the invention is preferably the type sold by M&T Chemical Company under the trademark TRICHROME which comprises an aqueous mixture of trivalent chromium ions and boric acid and is preferably heated to a bath temperature of about 110° F. to about 120° F. More specifically, the solution preferably contains from about 20 to about 25 and more preferably to about 23 grams of trivalent chromium ions and from about 60 to about 65 grams of boric acid per liter of the solution to provide a pH that is about 2 to 3 and more preferably from about 2.3 to about 2.7 and a specific gravity of about 1.20 to about 1.30 and more preferably from about 1.22 to about 1.26.

The above described electrolyte solution preferably further includes at least one stabilizer of which exlempary examples are citric acid, formic acid, and sodium formate that is used to keep all ionic chromium in the +3 valence state and which is preferably added in the amount of about 65 to about 75 milliters per liter of the electrolyte solution.

The above described electrolyte solution also further preferably includes a regulator of which exemplary examples are chromium III sulfate or a mixture of chromium III sulfate-chloride and conducting salts and of which the preferred example is the latter which is used to control the $Cr^{+3}$ ionic concentration of the electrolyte and the bulk electrical conductivity and which is added in the amount of from about 2 to about 4 milliters per liter of the electrolyte solution which is preferably agitated during the plating process such as by an air motor stirrer blade or other suitable agitator.

A suitable electrical power source such as a 6 to 12 volt rectifier 28 is connected between an anode (such as a graphite or a graphite composite) with engine valve 100 acting as the cathode. Although the battery generated direct current is preferably a steady electrical current, it may be pulsed as is a well known practice in the electroplating art. The electrical potential between the cathode and anode as such as to provide an electrical current density of from about 100 to about 150 amps per square foot of stem surface immersed in the solution and more preferably from about 110 to about 140 amps per square foot of stem surface immersed in the solution.

A time period of about 4 minutes in the above described electroplating solution will provide a substantially uniform coating of chromium on the valve stem having a thickness of about 0.00008 inch average.

The coated valve of step (a) is then removed from the electroplating solution, rinsed free of electroyte, and dried and then heated in step (b) in an oven referenced by numeral 30 at a temperature of at least about 150° F. for a time period of at least about 30 minutes in air or in a suitable inert atmosphere such as an argon or nitrogen atmosphere.

Although not completely understood, it is believed that the heating in step (b) creates a covalent bond between the chromium ions and carbon ions present in the trivalent chromium coating resulting in the formation of a chromium carbide bonding mechanism between the substrate and the chromium coating. It is also believed that various levels of oxidation may also occur converting the chromium ions to one or more ($Cr_xO_y$) oxides of chromium which would tend to raise the hardness level of the chromium coating, particularly at elevated temperatures, and that both $Cr_xO_y$ and $Cr_xO_y$ compounds would generate extreme hardness sites within the deposited coating, adding to the composite hardness observed.

The remarkable results of the above described electroplating and heating steps is the surprising increase to seizure life of trivalent chromium coating of the invention in comparison to hexavalent chromium heretofore believed to be exclusively used for valve stem electroplating.

Figure 3:
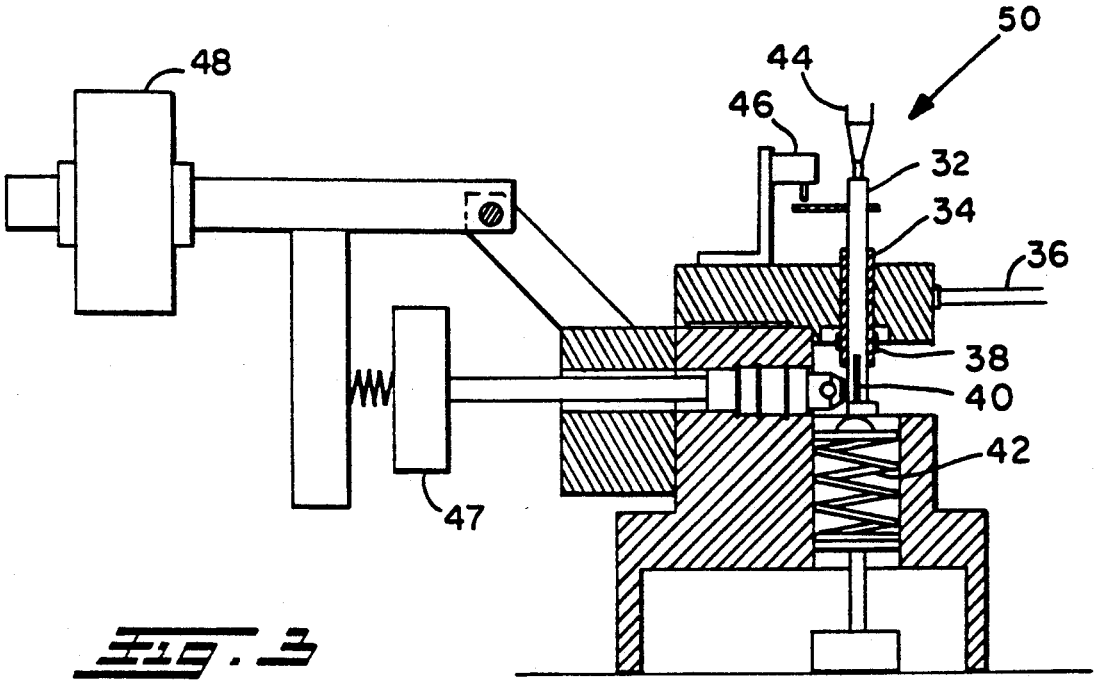
FIG. 3 is a schematic diagram of a valve stem seizure rig 50 for testing the seizure characteristics of engine valve stems.

A simulation test rig 50 developed for the evaluation of the seizure characteristics of valve stems and guides is shown in FIG. 3. It consists of a portion of valve stem 32 heated at the bottom end by a cartridge heater 40 to simulate the hot end of the stem and then coupled to control and measure the stem end temperature. Stem 32 is translated in guide 34 by a hydraulic actuator 44 of a MTS Hydraulic Testing machine. Guide 34 is inserted in a controlled temperature water cooled head 36. The hot end of guide 34 is brought up to the desired simulated temperature by an O.D. coil heater 38 at the bottom of the guide.

Valve stem 32 is subjected to a selected sideload generated by dead weight 48 through a movement arm and measured by load cell 47 by means of a roller follower. The valve stem is pushed down by actuator 44 against a compression return spring in each cycle. The stem motion is monitored by a proximity probe 46 which indicates the seizure as a low limit or zero output. Stem motion ceases when the return spring 42 can no longer overcome the stem friction in the guide as a result of the wear process. The number of hours run prior to seizure can be determined and compared for various stem guide combinations in FIG. 4.

Figure 4:
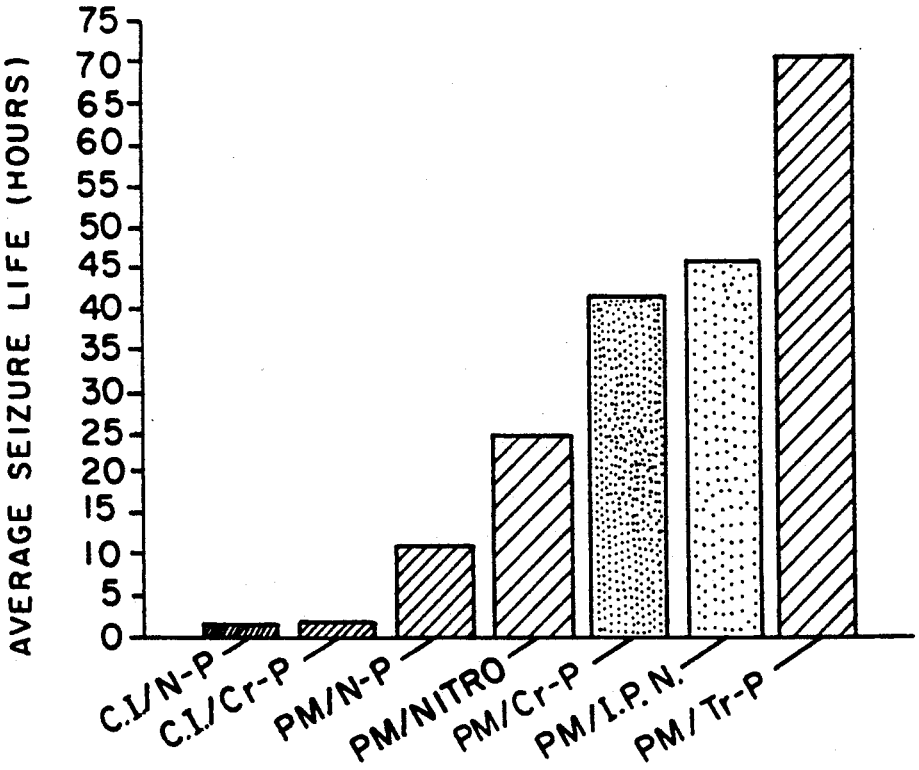
FIG. 4 is a bar graph comparing seizure times of a variety of other coatings to a coating of trivalent chromium made by the method of the present invention.

FIG. 4 presents a comparison of the seizure times observed in rig test 50 for a 21-2N austenitic steel valve stem. The temperature and load conditions for the test are listed in Table I. Untreated stems and stems with various coatings indicated in FIG. 4 are described in Table II and were tested against cast iron and P/M steel guides.

TABLE I

| | |
|---|---|
| Stem Temperature | 550° F. |
| Guide Temperature | 550° F. |
| Side Load | 50 pounds |
| Cycle Rate (HZ) | 10 |
| Strokes (inches) | 0.250 |

TABLE II

| Code | Guide | Stem |
|---|---|---|
| C.I./N-P | Cast Iron | Non-plated |
| C.I./Cr-P | Cast Iron | Hard chrome plated |
| PM/N-P | Powdered Metal | Non-plated |
| PM/NITRO | Powdered Metal | Nitrocarburized |
| PM/Cr-P | Powdered Metal | Hard Chrome (hexavalent plated) |
| PM/I.P.N. | Powdered Metal | Ion-plasma nitride |
| PM/Tr-P | Powdered Metal | Trivalent Chromium plated |

As can be seen from the bar graph of FIG. 4, the seizure life of a trivalent chromium coated valve stem (PM/Tr-P) exceeds its closest rival (ion plasma nitride) by about 25 hours and hexavalent chromium coated stem (PM/Cr-P) by about 28 hours or, as otherwise expressed, exhibits a seizure life of about 1.8 times that for hexavalent chromium.

Even if the seizure life of a trivalent chromium coating were the same as that for hexavalent chromium, the surprising result is that under the present invention it now possible to convert from highly toxic hexavalent chromium without sacrifice in seizure life for valves operating under today's higher engine temperatures and speed.

What is claimed is:

1. A method for providing a wear resistant chromium coating on a metallic internal combustion engine valve stem, said method including the steps of:

(a) electro-depositing a coating made solely from trivalent chromium ions and devoid of hexavalent chromium ions on the valve stem and, (b) heating the coating of step (a) to a temperature of at least about 150° F. for at least about 30 minutes.

2. The method of claim 1 wherein the chromium is electrodeposited as a coating on the valve in a aqueous solution containing trivalent chromium and boric acid.

3. The method of claim 2 wherein the solution has a pH of about 2.0 to about 3.0.

4. The method of claim 2 wherein the solution further includes at least one stabilizer.

5. The method of claim 2 or 4 wherein the solution further includes at least one regulator.

6. The method of claim 1 wherein the chromium is electrodeposited as a coating on the valve in an aqueous solution containing trivalent chromium, boric acid, at least one regulator, and at least one stabilizer, while the solution is at a temperature of about 110° F. to about 120° F. and has a pH of about 2.3 to about 2.7.

7. The method of claim 2 or 6 wherein the chromium is electrodeposited on the valve at an electrical current density of about 100 to about 150 amps per square foot of valve stem surface immersed in the solution.

8. A metallic engine valve having a stem having a wear resistant coating of chromium thereon, said chromium having been electro-deposited solely as trivalent chromium ions and devoid of hexavalent chromium ions thereon and then heated at a temperature of at least about 150° F. for at least 30 minutes.

* * * * *